US005300907A

United States Patent [19]

Nereau et al.

[11] Patent Number: 5,300,907

[45] Date of Patent: Apr. 5, 1994

[54] OPERATING MECHANISM OF A MOLDED CASE CIRCUIT BREAKER

[75] Inventors: Jean-Pierre Nereau, Seyssinet-Pariset; Philippe Perrier, Lumbin, both of France

[73] Assignee: Merlin Gerin, France

[21] Appl. No.: 6,795

[22] Filed: Jan. 21, 1993

[30] Foreign Application Priority Data

Feb. 7, 1992 [FR] France ..... 92 01486

[51] Int. Cl.[5] ..... H01H 9/00

[52] U.S. Cl. ..... 335/172; 335/21; 335/190

[58] Field of Search ..... 335/21-25, 335/167-176, 185-194

[56] References Cited

U.S. PATENT DOCUMENTS 3,436,710 4/1969 Stokes .
3,466,578 9/1969 Brumfield ..... 335/175
3,947,791 3/1976 Hennemann ..... 335/167
4,642,431 2/1987 Tedesco et al. ..... 335/16
4,710,738 12/1987 Neel et al. .
5,027,092 6/1991 Castonguay et al. ..... 335/21
5,121,092 6/1992 Castonguay et al. ..... 335/172

FOREIGN PATENT DOCUMENTS 0176025 4/1986 European Pat. Off. .
0206883 12/1986 European Pat. Off. .

*Primary Examiner*—Lincoln Donovan
*Attorney, Agent, or Firm*—Parkhurst, Wendel & Rossi

[57] ABSTRACT

An operating for a circuit breaker including a pivoting handle for controlling opening and closing of the circuit breaker and resetting of the latch after tripping. The handle bears a resetting roller which cooperates with a cam surface of the latch, which surface has a first cam section and a second cam section separated by a slope change point. The second section corresponds to the reset position and the slope of this section is chosen in such a way as to obtain a stable reset position of the handle.

6 Claims, 5 Drawing Sheets

OPERATING MECHANISM OF A MOLDED CASE CIRCUIT BREAKER

BACKGROUND OF THE INVENTION

The invention relates to an operating mechanism of a molded case low-voltage electrical circuit breaker comprising:

- a latch articulated on a fixed spindle and having a cam surface;
- a toggle formed by a toggle spindle, a first lever linked on the one hand to the movable contact and on the other hand to the toggle spindle, and a second lever articulated on the one hand on the latch and on the other hand on the toggle spindle;
- a spring attached on the one hand to the toggle spindle and on the other hand to the handle;
- a lock designed to cooperate with the latch to hold the latter in the locked position; and
- a cam-follower roller actuated by the handle and designed to cooperate with the cam surface of the latch to move the latch to the locked position, the handle being able to move to three distinct positions, a closed position in which the spring urges the toggle to an extension position, a manual opening and resetting position where the spring urges the toggle to a broken position wherein latch being in the locked position, and a tripped position in which the latch is unlocked and the toggle broken.

A circuit breaker of the kind mentioned above, for example described in U.S. Pat. No. 4,710,738, comprises an operating handle whose pivoting in either direction causes opening and closing of the circuit breaker contacts. When a fault occurs, notably an over-load or short-circuit, the contacts open automatically due to the action of a trip device and the handle moves to an intermediate tripped position between the closed position and the open position. To reset the circuit breaker, the handle has to be moved beyond the open position to a reset position where the latch is moved to the locking position. This reset position is an unstable position and the handle automatically returns to the open position when released. The latch being locked, the circuit breaker can again be reclosed and opened by a manual operation, or open automatically when a fault occurs. Nuisance unlocking of the latch may occur when the circuit breaker is open. Unlocking naturally causes the mechanism to be disarmed and the handle to return to the tripped position. Nuisance unloading can result from a wrong control or a mechanical action on the circuit breaker, or for any other reason, and a second resetting operation is necessary before the circuit breaker can be reclosed. Operating malfunctions of this kind can be bothersome, notably when remote controls are involved.

The object of the present invention is to achieve a circuit breaker mechanism holding the handle and latch in the loaded position, when nuisance tripping occurs.

SUMMARY OF THE INVENTION

The mechanism according to the invention is characterized in that the cam surface comprises a slope change point marking the limit between two successive sections, a first section corresponding appreciably to the travel of the handle between the tripped position and the reset position, and a second section corresponding to the reset position. The slope of the first section is such that the resultant of the forces derived from the spring and exerted on the handle urges the handle to the tripped position. The slope of the second section is such that the handle is urged to the reset position arranged as a stable position holding the latch.

By modifying the outline of the cam, the reset position of the handle is made stable and in this position this handle holds the latch regardless of the position of the latch. A tripping action releasing the lock is not hindered but does not have any effect, the latch remaining held by the handle. Any risk of deterioration of the tripping and locking system is thus prevented, which would be liable to occur in case of mechanical blocking of these systems to prevent nuisance tripping.

The latch is articulated at one of its ends on a fixed spindle, and the opposite end is arranged as a locking surface cooperating with the latch. The toggle is articulated at an intermediate point of the latch and the cam surface extends on the side of the end bearing the locking surface. The length of the second cam section is reduced, for example to a value smaller than the diameter of the roller, so as to have a setting travel corresponding to the relatively large length of the first section.

The invention is applicable to any circuit breaker mechanism with a rocker handle, whose resetting is performed by movement of the handle to or beyond the open position, but it will be described more particularly hereinafter as being applied to a circuit breaker of the type described in copending U.S. patent application Ser. No. 07/953,026, filed on Sep. 29, 1992 by the applicant, which Patent application should be advantageously referred to for further details on the general structure of the circuit breaker.

BRIEF DESCRIPTION OF THE DRAWINGS

Other advantages and features will become more clearly apparent from the following description of an illustrative embodiment of the invention, given as a non-restrictive example only and represented in the accompanying drawings in which.

DESCRIPTION OF THE PREFERRED EMBODIMENT

Figure 1:
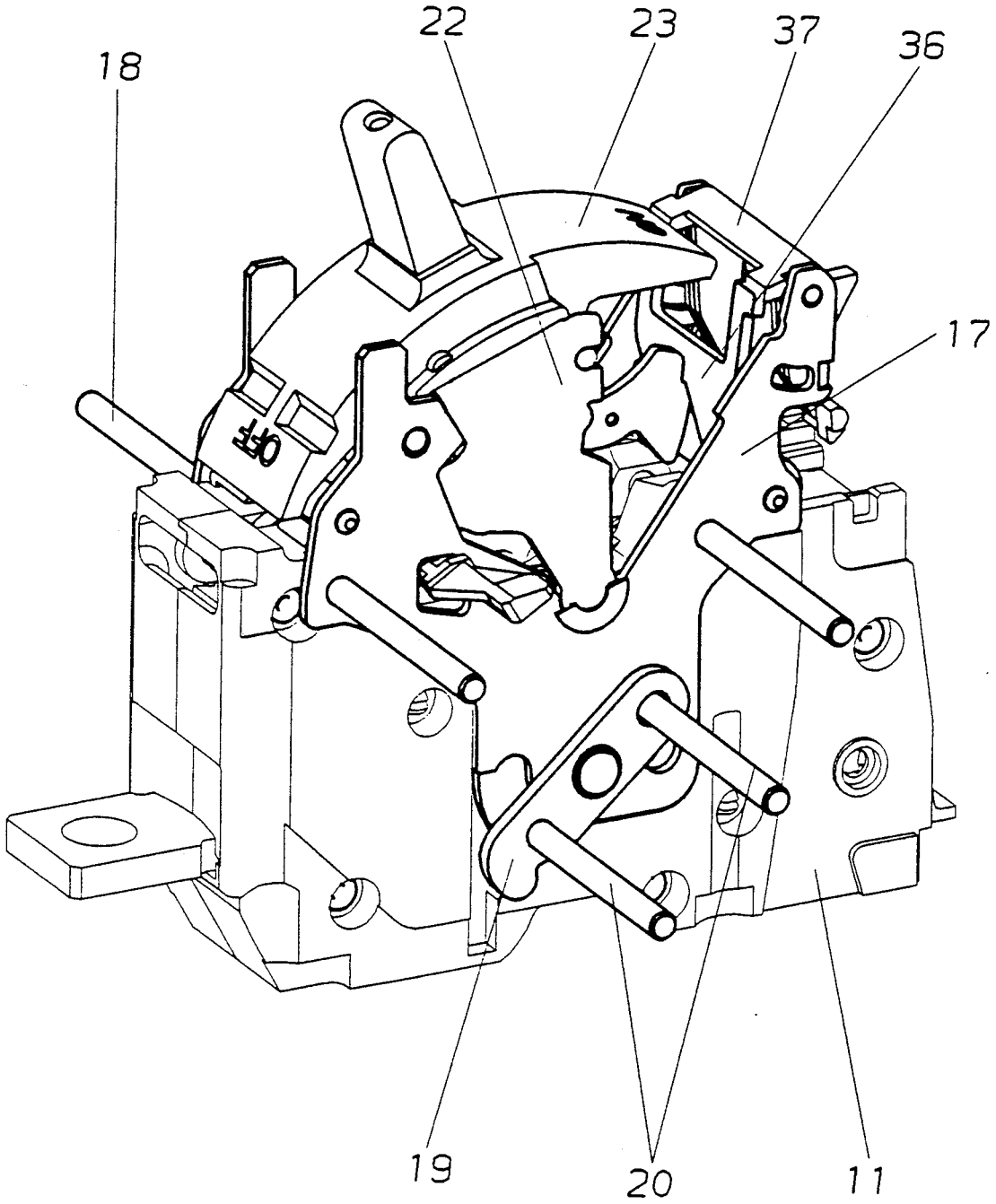
FIG. 1 is a schematic perspective view of a pole of the circuit breaker according to the invention.
Figure 2:
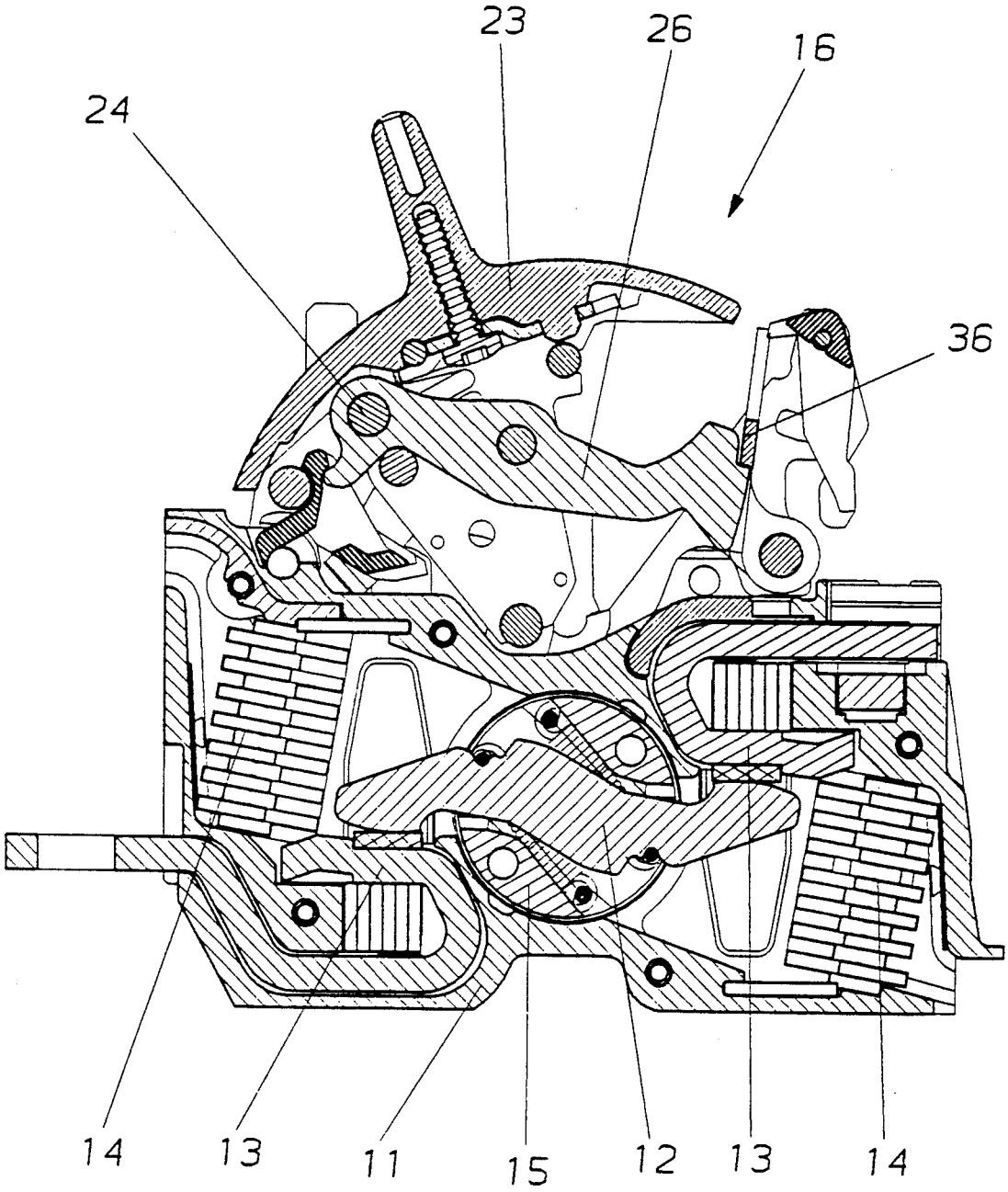
FIG. 2 is an axial sectional view of the circuit breaker according to the invention, represented in the closed position.

In FIGS. 1 and 2, a pole of a molded case circuit breaker can be seen which formed the subject of the above mentioned copending U.S. patent application Ser. No. 07/953,026, which is incorporated herein by reference. The pole 10 comprises a box 11 made of molded insulating material in which there are housed a contact bridge 12 which cooperates with stationary contacts 13, and extinguishing chambers 14. The contact bridge 12 is supported by a bar section 15 whose pivoting, bringing about opening and closing of the contacts 12, 13, is controlled by a mechanism designated by the general reference 16.

The mechanism 16 comprises two spaced apart flanges 17 fixedly secured to the box by rods 18. At the bottom part of the flanges 17, which frame the box 11, there is mounted with pivoting a crank 19 fixedly secured by bars 20 to the bar sections 15. On the flanges 17 a handle support 22 bearing a handle 23 is articulated by a spindle 21. One end 25 of a latch 26 is mounted in rotation on a fixed spindle 24 fixedly secured to the flanges 17, the other end bearing or being arranged as a locking surface 27. The crank 19 is mechanically connected to the latch 26 by a toggle 28 formed by a first lever 29 articulated by a toggle spindle 30 on the second lever 31, itself articulated by a spindle 32 on the latch 26. A traction spring 33 is attached on the one hand to the toggle spindle 30 and on the other hand at a point 34 to the handle support 22. A lock 36 articulated on a spindle 35 is biased tot he locking position of the latch 26 represented in FIGS. 3 and 4. In the locked position, the latch 26 exerts a force, via the locking surface 27, on the lock 36 urging the latter in the unlocking direction by clockwise pivoting in FIGS. 3 and 4. The lock 36 is held in the locked position by a catch 37, controlled by a trip device (not represented) bringing about automatic opening of the circuit breaker when a fault occurs.

Figure 3:
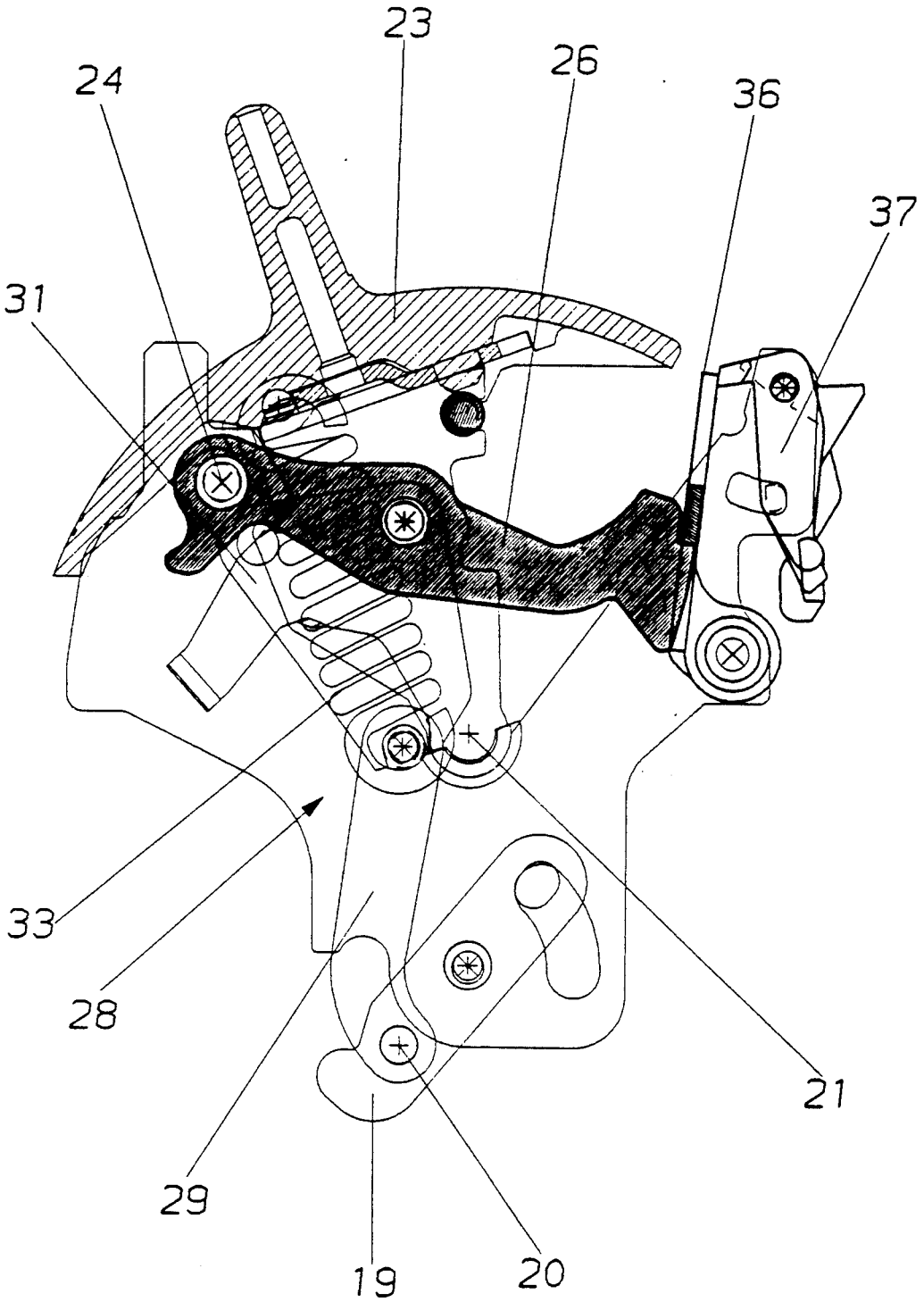
FIG. 3 is a partial view showing the mechanism in the closed position.
Figure 4:
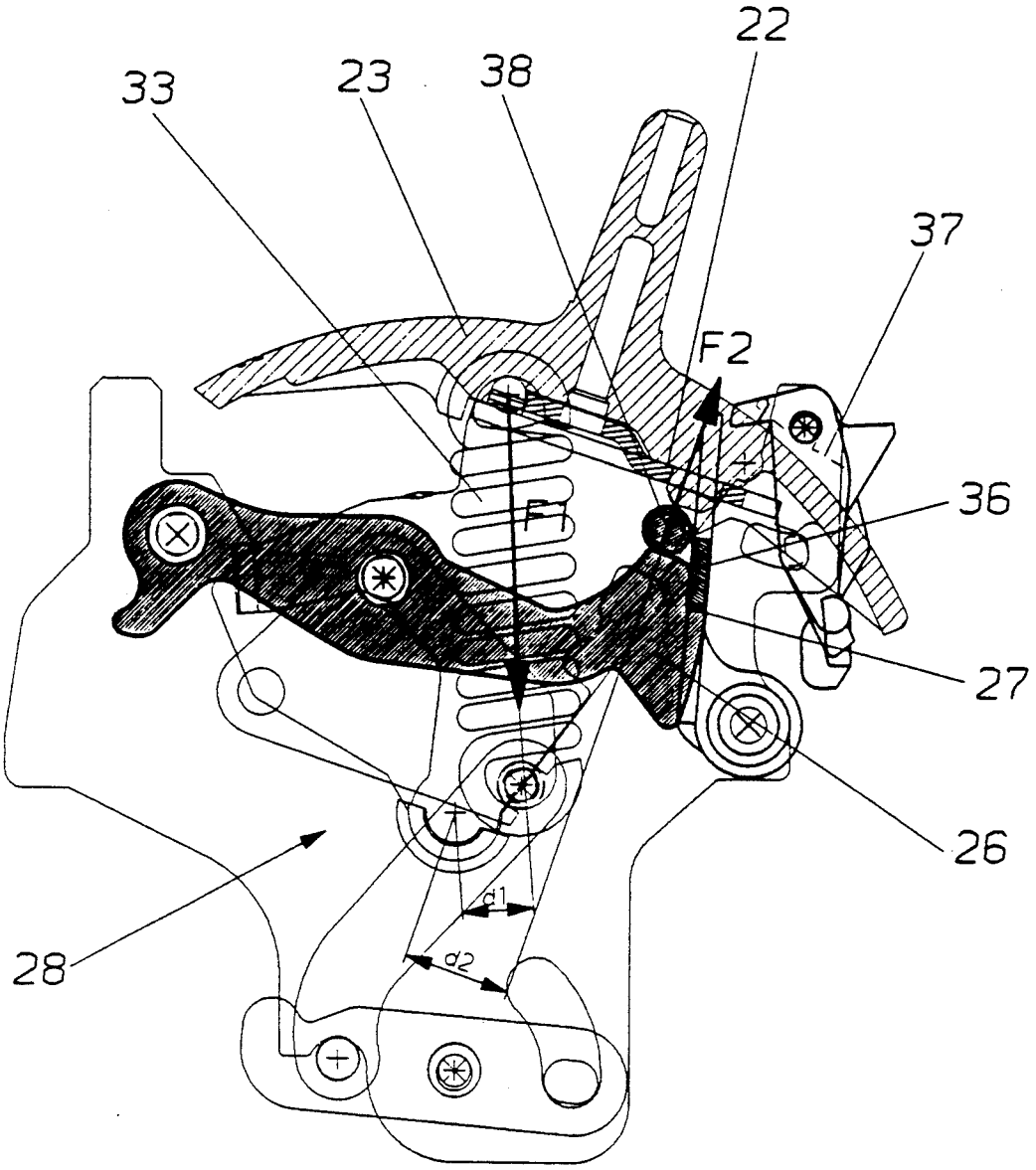
FIGS. 4 and 5 are similar views to that of FIG. 3, showing the mechanism respectively in the open-loaded, and tripped positions.

In the closed position represented in FIG. 3, the handle is placed in the closed position, and the spring 33 biases the toggle 28 in extension holding the contact bridge 12 in the closed position. This position is a stable position and manual opening of the circuit breaker is brought about by pivoting of the handle in the clockwise direction in FIG. 3 which, after the dead point has been passed, results in the toggle 28 being broken by the action of the spring 33. In the open position represented in FIG. 4, which is also a stable position, the toggle 28 holds the contact bridge 12 in the open position. In both these positions the latch 26 is locked by the lock 36. Automatic opening of the circuit breaker from the closed position represented in FIG. 3 is brought about by the trip device, releasing the catch 37 and causing unlocking by pivoting of the lock 36 and release of the locking surface 27. Due to the action of the spring 33, the released latch 26 pivots counterclockwise and causes opening of the contact bridge 12, moving the handle to the tripped position represented in FIG. 5. This intermediate position between the closed and open positions of the handle 23 is also a stable position, and resetting of the mechanism 10 is brought about by a manual action moving the handle 23 from the tripped position to the open position (FIG. 4). The handle support 22 bears a roller 38 which cooperates with a cam surface 39 arranged on the upper surface of the latch 26.

Figure 5:
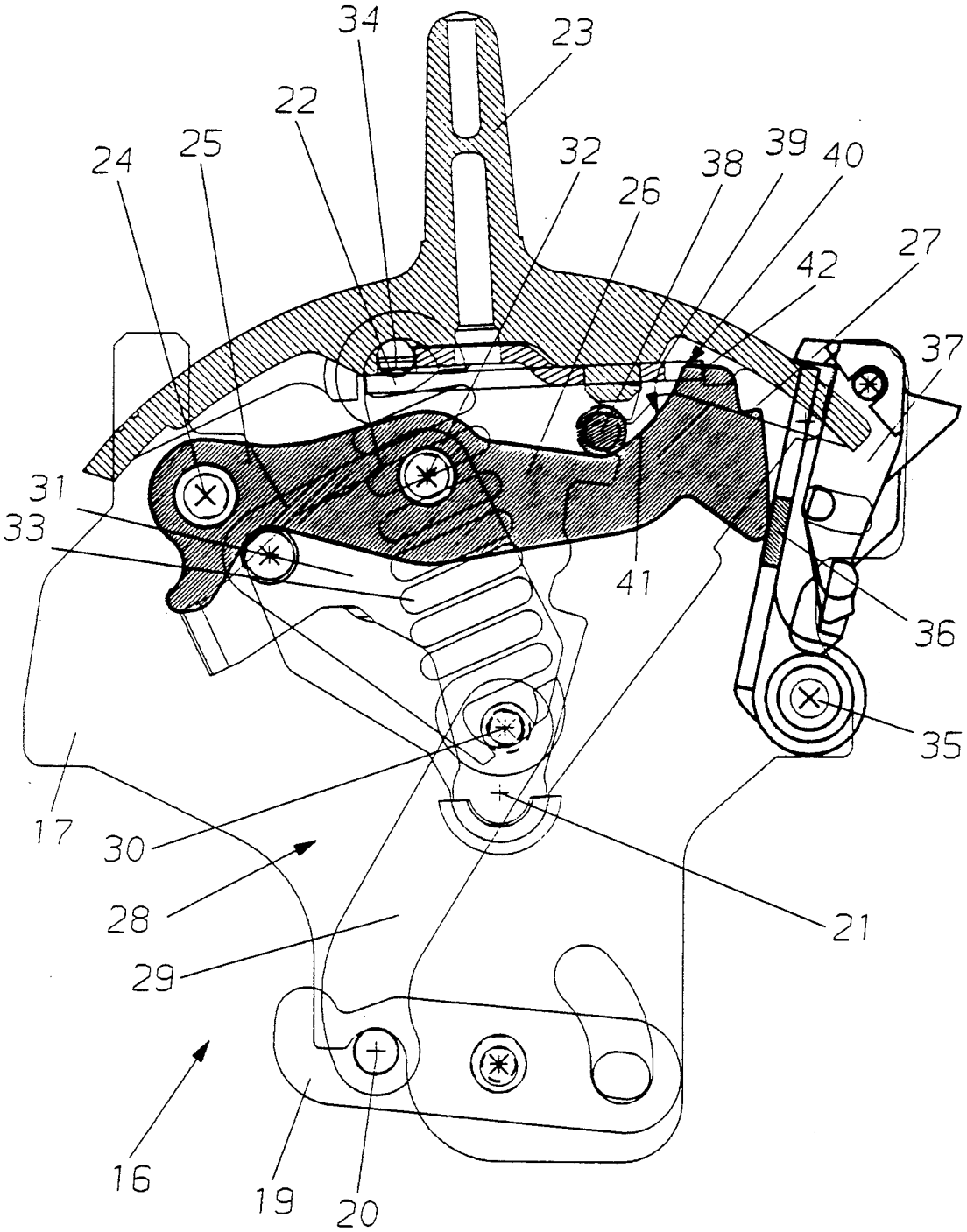

Referring to FIGS. 4 and 5, it can be seen that the roller 38, in the course of pivoting of the handle 23, imposes a downward movement in FIG. 5 of the latch 26 which, at the end of travel of the handle 23, pivots clockwise to the locking position represented in FIG. 4. The cam surface 39 has near the reset position an intermediate slope change point 40 with a first section 41 for moving the latch 26 to the reset position, and a second section 42 for holding the handle 23 in the reset position. The reset position of the handle 23, represented in FIG. 4, is a stable position, and this handle therefore remains in this position when released. In this position the catch 37 is free to pivot, releasing of the lock 36 having no effect on the latch 26 which is held by the roller 38. Nuisance unloading is thus excluded and the circuit breaker remains in the loaded position, ready for a closing operation, by a reverse movement of the handle 23 to the closed position.

The balance of forces acting on the handle 23 is represented in FIG. 4. This handle is subjected on the one hand to a direct action of the spring 33 on its attachment point 34, this force being represented by the arrow Fl in FIG. 6. It is eccentric by a lever arm d1 with respect to the pivoting axis 21 of the handle 23 and urges the latter to the reset position. The spring 33 moreover exerts, via the first toggle lever 29 of the latch 26 and the second section 40 of the cam 39, a force F2 eccentric by a lever arm d2 with respect to the pivoting axis 21 of the handle. The movement generated by this force F2 tends to move the handle 23 to the closed position against the torque generated by the force Fl. According to the invention, the system is arranged in such a way that the torque generated by the force Fl is greater than that generated by the force F2, in order to urge the handle 23 to the reset position. This can be achieved by a suitable choice of the slope of the second section 42 of the cam 39 which modifies the lever arm D2. The length of the second section 42 can be reduced, for example to a value close to the diameter of the roller 38, so as to keep a notable length of the first section 41 and thus limit the actuation force of the handle 23 for the resetting operation.

The invention is naturally applicable to other types of mechanisms or locking, and can be used for single-break circuit breakers.

We claim:

1. An operating mechanism of a molded case low-voltage electrical circuit breaker, said circuit breaker comprising a handle and at least one movable contact, said operating mechanism controlling manual opening, manual closing and automatic opening of the circuit breaker, said operating mechanism comprising:

a latch articulated on a fixed spindle and having a cam surface;

a toggle comprising a first lever linked to the movable contact of the circuit breaker, and a second lever articulated on the latch via an articulation spindle, the first and second levers being joined to each other via a toggle spindle;

a spring attached to the toggle spindle and to the handle;

a lock designed to cooperate with said latch to hold said latch in a locked position; and a cam-follower roller actuated by the handle and designed to cooperate with the cam surface of the latch to move the latch to the locked position, said handle being able to move between (i) a closed position wherein the spring urges the toggle toward an extension position, (ii) a reset position wherein the spring urges the toggle to a broken position, the latch being in the locked position and the circuit breaker being open, and (iii) a tripped position wherein the latch is unlocked and the toggle is urged toward the broken position, wherein the cam surface comprises a slope change point between a first section corresponding appreciably to the travel of the handle between the tripped position and the reset position, and a second section corresponding to the reset position, the slope of the first section being such that the resultant of the forces derived from the spring and exerted on the handle urges the handle to the tripped position, the slope of the second section being such that the handle is urged to the reset position such that when the handle is in the reset position, the handle is maintained in the reset position upon unlocking of the latch via movement of the lock.

2. The operating mechanism according to claim 1, wherein the latch has an end articulated on said fixed spindle and an opposite end having a locking surface for cooperation with said lock, and wherein the articulation spindle of said second lever is fitted on the latch between the two ends of the latch.

3. The operating mechanism according to claim 1, wherein said lock is urged in an unlocking direction by the latch and is kept locked by a catch controlled by a trip device.

4. The operating mechanism according to claim 1, wherein in the reset position the spring exerts directly on the handle a first force whose moment urges the handle to a set position, and wherein the spring exerts indirectly on the handle via the second lever, latch, second cam section and roller, a second force whose moment which urges the handle in a reverse tripping direction, the moment of the second force being smaller than the moment of the first force.

5. The operating mechanism according to claim 1, wherein the length of said second section is approximately equal to the diameter of the roller.

6. The operating mechanism according to claim 1, wherein in the reset position of the handle, the roller contacts the second section slightly beyond the locking position defined by the lock.

* * * * *